US011028856B2

(12) United States Patent
Kiriaki et al.

(10) Patent No.: US 11,028,856 B2
(45) Date of Patent: Jun. 8, 2021

(54) CENTRIFUGAL COMPRESSOR IMPELLER

(71) Applicant: IHI Corporation, Koto-ku (JP)

(72) Inventors: Takuro Kiriaki, Koto-ku (JP); Soumya Dutta, Koto-ku (JP)

(73) Assignee: IHI Corporation, Koto-ku (JP)

( * ) Notice: Subject to any disclaimer, the term of this patent is extended or adjusted under 35 U.S.C. 154(b) by 351 days.

(21) Appl. No.: 16/086,238

(22) PCT Filed: Apr. 7, 2017

(86) PCT No.: PCT/JP2017/014515

§ 371 (c)(1),
(2) Date: Sep. 18, 2018

(87) PCT Pub. No.: WO2017/195512

PCT Pub. Date: Nov. 16, 2017

(65) Prior Publication Data

US 2020/0386239 A1 Dec. 10, 2020

(30) Foreign Application Priority Data

May 9, 2016 (JP) ..... JP2016-093985

(51) Int. Cl.
*F04D 29/30* (2006.01)
*F04D 29/28* (2006.01)
(Continued)

(52) U.S. Cl.
CPC ..... *F04D 29/30* (2013.01); *F04D 29/284* (2013.01); *F04D 17/10* (2013.01);
(Continued)

(58) Field of Classification Search
CPC ..... F04D 29/284; F04D 29/30; F04D 29/666; F04D 29/2216; F05D 2240/305; F05D 2240/306
See application file for complete search history.

(56) References Cited

U.S. PATENT DOCUMENTS 4,093,401 A * 6/1978 Gravelle ..... F04D 29/284 415/143
6,754,954 B1 6/2004 Decker
(Continued)

FOREIGN PATENT DOCUMENTS

CN 101010157 A 8/2007
CN 102720692 A 10/2012
(Continued)

OTHER PUBLICATIONS

International Search Report dated Jun. 13, 2017, in PCT/JP2017/014515 filed Apr. 7, 2017.

*Primary Examiner* — Ninh H. Nguyen
(74) *Attorney, Agent, or Firm* — Oblon, McClelland, Maier & Neustadt, L.L.P.

(57) ABSTRACT

Provided is a centrifugal compressor impeller that includes: a hub; a plurality of full blades that are arranged on the hub in a circumferential direction of rotation; and splitter blades provided between the full blades. There is a line-of-sight direction which is a direction parallel to a virtual plane perpendicular to a rotation axis and in which an entire suction surface of the full blade adjacent to a front side of the splitter blade in a rotational direction, an entire pressure surface of the full blade adjacent to a rear side of the splitter blade in the rotational direction, and an entire surface of the splitter blade are visible.

3 Claims, 5 Drawing Sheets

(51) Int. Cl.
*F04D 17/10* (2006.01)
*F04D 29/42* (2006.01)
*F04D 29/44* (2006.01)

(52) U.S. Cl.
CPC ..... *F04D 29/4213* (2013.01); *F04D 29/444* (2013.01); *F05D 2240/304* (2013.01)

(56) References Cited

U.S. PATENT DOCUMENTS

| | | | | |
|---|---|---|---|---|
| 8,007,241 | B2 * | 8/2011 | Vadillo | F04D 29/281 416/203 |
| 9,689,263 | B2 * | 6/2017 | Gharaibah | F04D 27/0292 |
| 2002/0185244 | A1 | 12/2002 | Decker et al. | |
| 2002/0187060 | A1 | 12/2002 | Decker et al. | |
| 2004/0052644 | A1 | 3/2004 | Decker et al. | |
| 2004/0062645 | A1 | 4/2004 | Decker et al. | |
| 2007/0031261 | A1 * | 2/2007 | Lombard | F01D 5/048 416/203 |
| 2008/0289332 | A1 | 11/2008 | Decker et al. | |
| 2009/0136357 | A1 | 5/2009 | Vadillo | |
| 2009/0252609 | A1 | 10/2009 | Kubota | |
| 2009/0274560 | A1 | 11/2009 | Kubota et al. | |
| 2012/0294739 | A1 | 11/2012 | Nishimura et al. | |
| 2014/0328689 | A1 | 11/2014 | Ishikawa et al. | |
| 2015/0063989 | A1 | 3/2015 | Wang et al. | |
| 2015/0176422 | A1 | 6/2015 | Dimova et al. | |

FOREIGN PATENT DOCUMENTS

| | | | |
|---|---|---|---|
| CN | 102762873 | A | 10/2012 |
| CN | 103890408 | A | 6/2014 |
| CN | 104364493 | A | 2/2015 |
| JP | 61-283797 | A | 12/1986 |
| JP | 64-15497 | A | 1/1989 |
| JP | 64-36120 | U | 3/1989 |
| JP | 3-267599 | A | 11/1991 |
| JP | 2003-94148 | A | 4/2003 |
| JP | 2005-48769 | A | 2/2005 |
| JP | 2008-223532 | A | 9/2008 |
| JP | 2014-238084 | A | 12/2014 |
| JP | 2015-521709 | A | 7/2015 |
| WO | WO 2006/090701 | A1 | 8/2006 |
| WO | WO 2011/102120 | A1 | 8/2011 |
| WO | WO 2013/058284 | A1 | 4/2013 |

* cited by examiner (a)

(b)

CENTRIFUGAL COMPRESSOR IMPELLER

TECHNICAL FIELD

The present disclosure relates to a centrifugal compressor impeller.

BACKGROUND ART

Conventionally, as technology of this field, a centrifugal compressor impeller set forth in Patent Literature 1 below is known. Patent Literature 1 describes that the impeller is made by injection molding.

CITATION LIST

Patent Literature

[Patent Literature 1] Japanese Unexamined Patent Publication No. 2014-238084

SUMMARY OF INVENTION

Technical Problem

In general, since the centrifugal compressor impeller has blades, each of which includes a complicated curved surface, mold release is problematic when the impeller is made by injection molding. That is, in the case of molds for forming the blades, there is a need to avoid interference between each blade and the mold in the event of the mold release. Therefore, if a shape of the blade is complicated, there is a need to divide the molds into numerous molds, to enable them to be released, and the productivity becomes worse. On the other hand, releasing the molds in a direction of a rotation axis of the impeller can also be considered. However, in the impeller in which the molds can be released in the direction of the rotation axis, the shape of the blade is greatly restricted, and thus there is no choice but to simplify the shape of the blade. As a result, there is no choice but to sacrifice the performance of the impeller.

The present disclosure describes a centrifugal compressor impeller that improves productivity by means of injection molding while suppressing a reduction in performance.

Solution to Problem

A centrifugal compressor impeller according to an aspect of the present disclosure includes: a hub; a plurality of full blades that are arranged on the hub in a circumferential direction of rotation; and splitter blades provided between the full blades. There is a line-of-sight direction which is a direction parallel to a virtual plane perpendicular to a rotation axis and in which an entire suction surface of the full blade adjacent to a front side of the splitter blade in a rotational direction, an entire pressure surface of the full blade adjacent to a rear side of the splitter blade in the rotational direction, and an entire surface of the splitter blade are visible.

Effects of Invention

According to the centrifugal compressor impeller of the present disclosure, it is possible to improve productivity by means of injection molding while suppressing a reduction in performance.

DESCRIPTION OF EMBODIMENTS

A centrifugal compressor impeller according to an aspect of the present disclosure includes: a hub; a plurality of full blades that are arranged on the hub in a circumferential direction of rotation; and splitter blades provided between the full blades. There is a line-of-sight direction which is a direction parallel to a virtual plane perpendicular to a rotation axis and in which an entire suction surface of the full blade adjacent to a front side of the splitter blade in a rotational direction, an entire pressure surface of the full blade adjacent to a rear side of the splitter blade in the rotational direction, and an entire surface of the splitter blade are visible.

A centrifugal compressor impeller of the present disclosure includes: a hub; a plurality of full blades that are arranged on the hub in a circumferential direction of rotation; and splitter blades provided between the full blades. There is a line-of-sight direction which is a direction parallel to a virtual plane perpendicular to a rotation axis and in which an entire surface of the splitter blade is visible. When the sum of the number of full blades and the number of splitter blades is defined as N, an opening angle of the full blade is defined as $\alpha$, and an opening angle of the splitter blade is defined as $\beta$, $\alpha \leq (360°/N)+\beta$.

A centrifugal compressor impeller of the present disclosure includes: a hub; and a plurality of full blades that are arranged on the hub in a circumferential direction of rotation. There is a line-of-sight direction which is a direction parallel to a virtual plane perpendicular to a rotation axis and in which an entire suction surface of one full blade and an entire pressure surface of another full blade adjacent to the suction surface are visible.

First Embodiment

Hereinafter, a centrifugal compressor impeller 1 (hereinafter referred to simply as an "impeller 1") according to an embodiment of the present disclosure will be described in detail with reference to the drawings.

Figure 1:
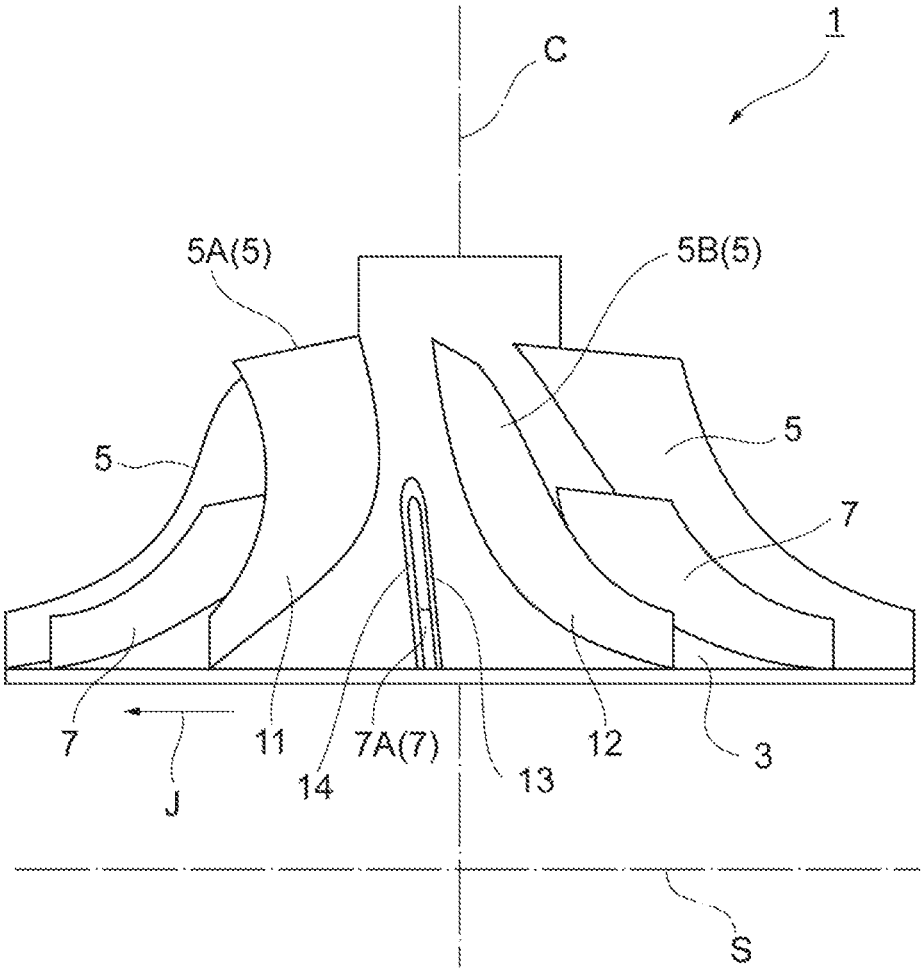
FIG. 1 is a side view of a centrifugal compressor impeller of a first embodiment.

An impeller 1 illustrated in FIG. 1 is rotated about a rotation axis C in a direction of an arrow J in a centrifugal compressor, and discharges a gas, which is introduced in a direction of the rotation axis C, in a radial direction of rotation. The impeller 1 includes a hub 3 and a plurality of (e.g., six) full blades 5 that are arranged on the hub 3 at regular intervals in a circumferential direction of rotation. The impeller 1 includes a plurality of (e.g., six) splitter blades 7 that are provided between the full blades 5 one by one.

Here, attention is paid to one splitter blade 7 of the impeller 1 and two full blades 5 between which this splitter blade 7 is sandwiched in the circumferential direction of rotation. The splitter blade 7 to which attention is paid will be called a "splitter blade 7A." The full blade 5 adjacent to a front side of the splitter blade 7A in a rotational direction will be called a "full blade 5A." The full blade 5 adjacent to a rear side of the splitter blade 7A in the rotational direction will be called a "full blade 5B." In addition, a virtual plane perpendicular to the rotation axis C will be referred to as a virtual plane S.

In the impeller 1, there is a line-of-sight direction which is a direction parallel to the virtual plane S and in which an entire suction surface 11 of the full blade 5A, an entire pressure surface 12 of the full blade 5B, and an entire surface of the splitter blade 7A are visible. A suction surface 13, pressure surface 14, leading edge and trailing edge of the splitter blade 7A are included in the surface of the splitter blade 7A. The line-of-sight direction is a direction of an outlet blade angle of the splitter blade 7A. FIG. 1 is a side view of the impeller 1 viewed in the line-of-sight direction.

In contrast, when the impeller 1 is viewed with a line of sight parallel to the rotation axis C, at least a part of the suction surface 11 of the full blade 5A, the pressure surface 12 of the full blade 5B, and the surface of the splitter blade 7A is not visible.

Here, the wording "an entire certain surface T on the impeller 1 is visible" means that all points on the surface T are visible in whole without being hidden by other parts on a surface of the impeller 1. In this case, even when there is a set of points that appear to overlap on the surface T, this is included in a state in which "the entire surface T is visible."

The condition described above that "in the impeller 1, there is a line-of-sight direction which is a direction parallel to the virtual plane S and in which an entire suction surface 11 of the full blade 5A and an entire pressure surface 12 of the full blade 5B are visible" will be considered. If the condition is satisfied, when the sum of the number of full blades 5 and the number of splitter blades 7 of the impeller 1 is defined as N, an opening angle of the full blade 5 is defined as $\alpha$, and an opening angle of the splitter blade 7 is defined as $\beta$, $\alpha \leq (360°/N)+\beta$ is required.

Figure 2:
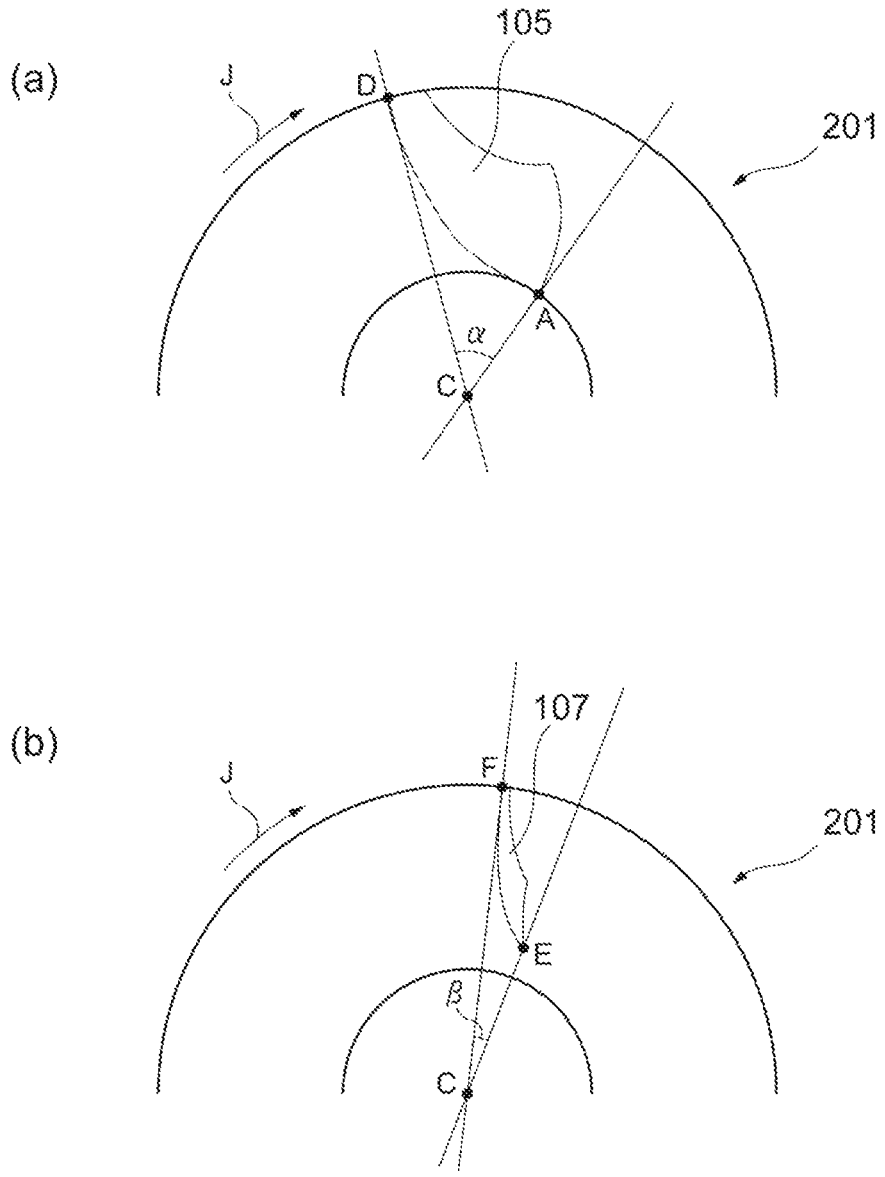
FIGS. 2(*a*) and 2(*b*) are views illustrating a shape in which a blade of a general centrifugal compressor impeller is projected onto a plane perpendicular to a rotation axis.

Here, the definition of the opening angle of the blade of the impeller will be described with reference to FIG. 2. FIG. 2(*a*) is view in which one full blade 105 of a general centrifugal compressor impeller 201 is projected onto the virtual plane S (see FIG. 1) perpendicular to the rotation axis C. FIG. 2(*b*) is view in which one splitter blade 107 of the centrifugal compressor impeller 201 is projected onto the virtual plane S.

In FIG. 2, a point C indicates a rotation axis of the impeller 201, a point A indicates an end close to a hub on a leading edge of the full blade 105, a point D indicates an end close to a hub on a trailing edge of the full blade 105, a point E indicates an end close to a hub on a leading edge of the splitter blade 107, and a point F indicates an end close to a hub on a trailing edge of the splitter blade 107.

As illustrated in FIG. 2(*a*), an opening angle $\alpha$ of the full blade 105 is defined as an angle formed by a line CA and a line CD on the virtual plane S. Similarly, an opening angle $\beta$ of the splitter blade 107 is defined as an angle formed by a line CE and a line CF on the virtual plane S.

Next, operation and effects caused by the impeller 1 will be described. As described above, there is a line-of-sight direction which is the direction parallel to the virtual plane S and in which the entire suction surface 11 of the full blade 5A, the entire pressure surface 12 of the full blade 5B, and the entire surface of the splitter blade 7A are visible in the impeller 1. Therefore, even when injection molds for forming the suction surface 11 of the full blade 5A, the pressure surface 12 of the full blade 5B, and the splitter blade 7A are integrated, the molds can be released in the line-of-sight direction (the direction of the outlet blade angle of the splitter blade 7A). That is, in FIG. 1, the molds can be released forward in a direction perpendicular to the surface of the page.

Therefore, in the injection molding of the impeller 1, molds can be allocated between the full blades 5 one by one. All the full blades 5 and splitter blades 7 can be formed by molds of the same number (six) as the full blades 5. In this case, each mold is displaced and released along a linear track in the direction parallel to the virtual plane S. That is, six full blades 5 and six splitter blades 7 of the impeller 1 can be formed by a relatively small number of molds having the same number (six) as the number of full blades 5. When the molds are released, each mold may be displaced along the linear track in the direction parallel to the virtual plane S. Therefore, the productivity of the impeller 1 is improved by injection molding.

The impeller 1 has a shape in which the molds for forming the full blades 5 and the splitter blades 7 are released in the direction parallel to the virtual plane S. Therefore, in comparison with an impeller that allows the molds to be released in the direction of the rotation axis C, it is not necessary to extremely simplify shapes of the full blades 5 and the splitter blades 7, and a reduction in performance of the impeller 1 can be suppressed.

As described above, when the impeller 1 is viewed with a line of sight parallel to the rotation axis C, at least a part of the suction surface 11 of the full blade 5A, the pressure surface 12 of the full blade 5B, and the surface of the splitter blade 7A is not visible. Therefore, there is no injection mold by which the full blades 5 and splitter blades 7 of the impeller 1 can be integrally formed and in which the molds can be released in the direction of the rotation axis C.

Hereinafter, results of CFD analysis performed by the inventors with regard to the performance of the impeller 1 will be described.

Figure 3:
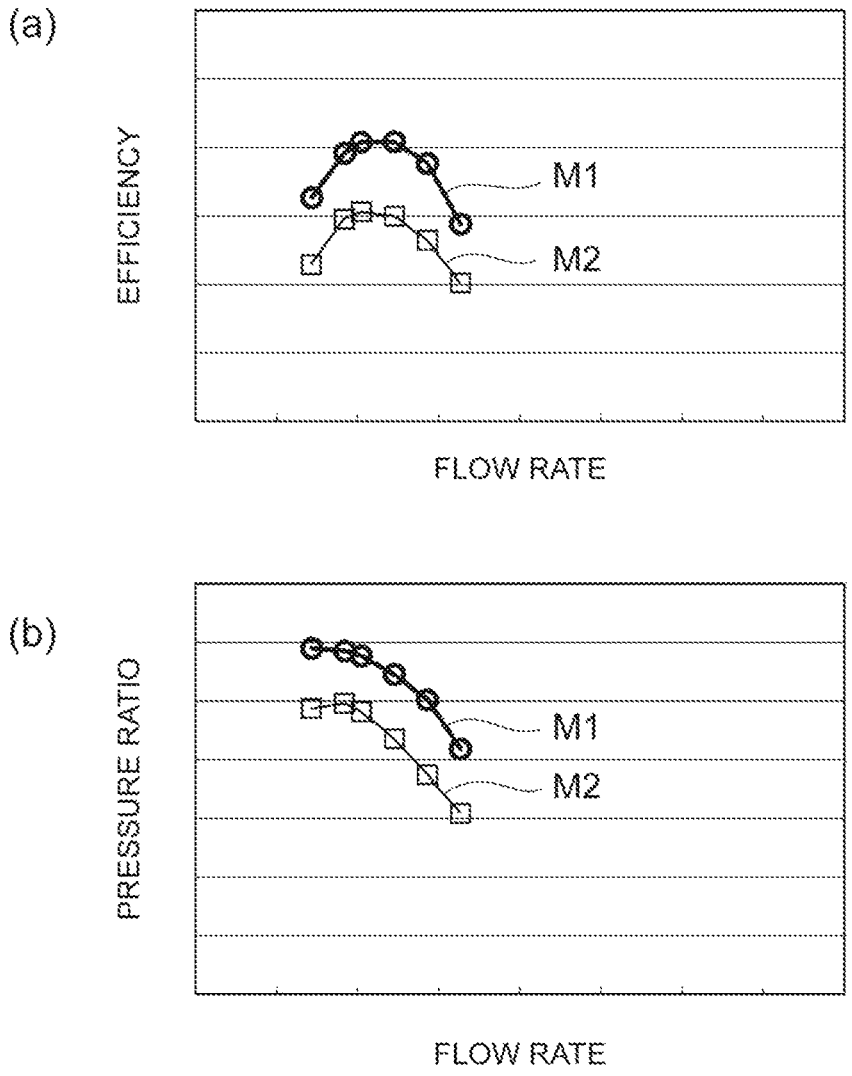
FIGS. 3(*a*) and 3(*b*) are views illustrating test results obtained by the inventors.

The inventors prepared models M1 and M2 of the impeller to perform CFD analysis. The impeller of the model M1 includes full blades and splitter blades having complicated shapes without satisfying the conditions of the impeller 1. The impeller of the model M2 includes full blades and splitter blades having such simple shapes as to be able to be manufactured by molds that can be released in the direction of the rotation axis C. Results of the CFD analysis are shown in FIGS. 3(*a*) and 3(*b*). FIG. 3(*a*) is a graph illustrating a relation between a flow rate (a horizontal axis) and efficiency (a vertical axis) of the impeller. FIG. 3(*b*) is a graph illustrating a relation between a flow rate (a horizontal axis) and a pressure ratio (a vertical axis) of the impeller. As found by comparing the model M1 with the model M2, when a blade shape of the impeller is easily simplified, it is found that a reduction in efficiency and pressure ratio is caused. Especially, with regard to the efficiency, the efficiency of the model M2 was 5 points (5%) with respect to the model M1, and was relatively greatly reduced.

Further, the inventors prepared models M1' and M3 of the impeller to perform CFD analysis. Like the model M1, the impeller of the model M1' includes full blades and splitter blades having complicated shapes without satisfying the conditions of the impeller 1. The impeller of the model M3 satisfies the conditions of the aforementioned impeller 1.

Figure 4:
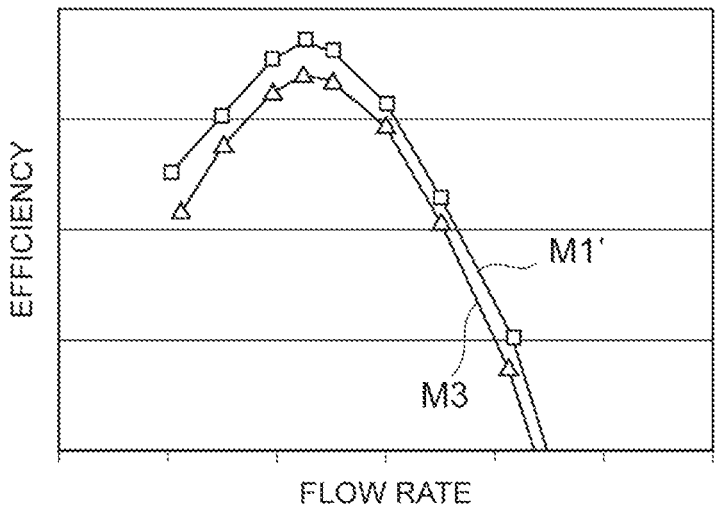
FIGS. 4(*a*) and 4(*b*) are views illustrating test results obtained by the inventors.
Figure 4:
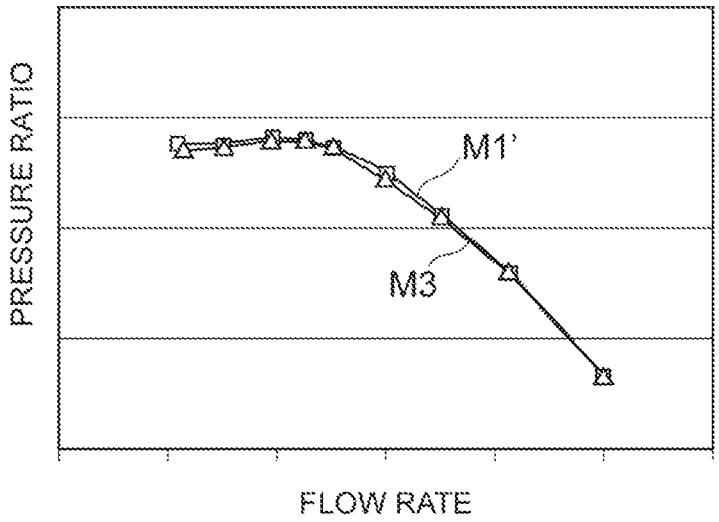

Results of the CFD analysis are shown in FIGS. 4(*a*) and 4(*b*). FIG. 4(*a*) is a graph illustrating a relation between a flow rate (a horizontal axis) and efficiency (a vertical axis) of the impeller. FIG. 4(*b*) is a graph illustrating a relation between a flow rate (a horizontal axis) and a pressure ratio (a vertical axis) of the impeller. As found by comparing the model M1' with the model M3, the pressure ratio obtained in the model M3 is not inferior to that of the model M1'. A reduction in the efficiency of the model M3 was 1.5 points (1.5%) with respect to the model M1, and was suppressed to a relatively small level. Thereby, according to the impeller 1, in comparison with the impeller such as the model M1', it was proved that an extreme reduction in performance did not occur.

Second Embodiment

Figure 5:
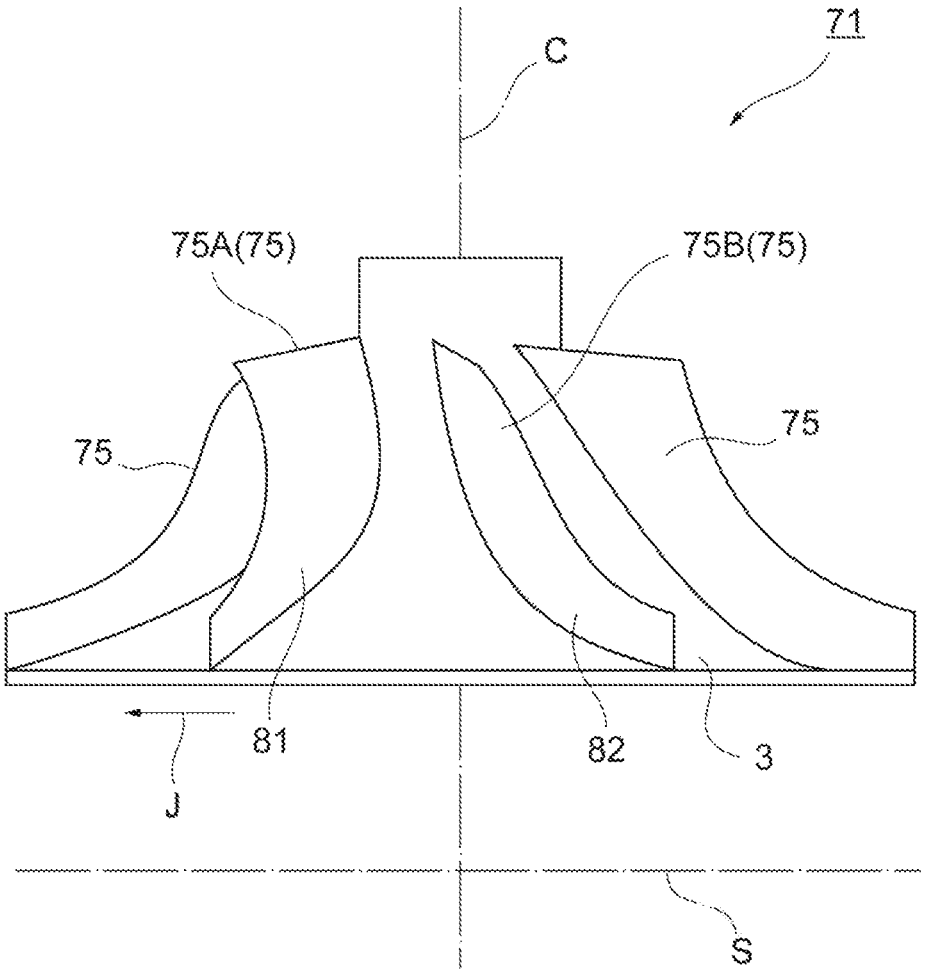
FIG. 5 is a side view of a centrifugal compressor impeller of a second embodiment.

A centrifugal compressor impeller 71 illustrated in FIG. 5 is a centrifugal compressor impeller that includes a hub 3 and a plurality of (e.g., six) full blades 75 arranged on the hub 3 in a circumferential direction of rotation at regular intervals. The impeller 71 does not include the splitter blades 7 (see FIG. 1) which the impeller 1 of the first embodiment includes. In the impeller 71, there is a line-of-sight direction which is a direction parallel to a virtual plane S perpendicular to a rotation axis C and in which an entire suction surface 81 of one full blade 75A and an entire pressure surface 82 of another full blade 75B adjacent to the suction surface 81 are visible. FIG. 5 is a side view of the impeller 1 in the line-of-sight direction. To satisfy the condition of there being the line-of-sight direction as described above, when the number of full blades 75 is defined as M, it is required that an opening angle $\alpha$ of the full blade 75 be $\alpha \leq 360°/M$. When the impeller 71 is viewed with a line of sight parallel to the rotation axis C, at least a part of the suction surface 81 of the full blade 75A and the pressure surface 82 of the full blade 75B is not visible. The same operation and effects as the impeller 1 of the first embodiment are also exerted by the impeller 71 as described above.

The present disclosure can be carried out in various modes subjected to various alterations and improvements on the basis of knowledge of those skilled in the art, starting with the aforementioned embodiments. A modification can also be configured using the technical matters set forth in the aforementioned embodiments. The configurations of the embodiments may be appropriately combined and used. For example, in the first embodiment, the impeller 1 having the six full blades 5 and the six splitter blades 7 has been described by way of example. However, the present disclosure can also be equally applied to an impeller that includes a different number of full blades and splitter blades. In the second embodiment, the impeller 71 having the six full blades 75 has been described by way of example. However, the present disclosure can also be equally applied to an impeller that includes a different number of full blades.

REFERENCE SIGNS LIST

1 Centrifugal compressor impeller
3 Hub
5, 5A, 5B Full blade
7, 7A Splitter blade
11 Suction surface
12 Pressure surface
71 Centrifugal compressor impeller
75, 75A, 75B Full blade
81 Suction surface
82 Pressure surface
C Rotation axis
S Virtual plane

The invention claimed is:

1. A centrifugal compressor impeller comprising:
a hub;
a plurality of full blades that are arranged on the hub in a circumferential direction of rotation; and
splitter blades provided between the full blades,
wherein there is a line-of-sight direction which is a direction parallel to a virtual plane perpendicular to a rotation axis and in which an entire suction surface of the full blade adjacent to a front side of the splitter blade in a rotational direction, an entire pressure surface of the full blade adjacent to a rear side of the splitter blade in the rotational direction, and an entire surface of the splitter blade are visible, and
when the sum of the number of full blades and the number of splitter blades is defined as N, an opening angle of the full blade is defined as $\alpha$, and an opening angle of the splitter blade is defined as $\beta$, $\alpha \leq (360°/N)+\beta$.

2. A centrifugal compressor impeller comprising:
a hub;
a plurality of full blades that are arranged on the hub in a circumferential direction of rotation; and
splitter blades provided between the full blades,
wherein there is a line-of-sight direction which is a direction parallel to a virtual plane perpendicular to a rotation axis and in which an entire surface of the splitter blade is visible, and
when the sum of the number of full blades and the number of splitter blades is defined as N, an opening angle of the full blade is defined as $\alpha$, and an opening angle of the splitter blade is defined as $\beta$, $\alpha \leq (360°/N)+\beta$.

3. A centrifugal compressor impeller comprising:
a hub;
a plurality of full blades that are arranged on the hub in a circumferential direction of rotation; and
splitter blades provided between the full blades,
wherein there is a line-of-sight direction which is a direction parallel to a virtual plane perpendicular to a rotation axis and in which an entire suction surface of one full blade, an entire pressure surface of another full blade adjacent to the suction surface, and an entire surface of the splitter blade are visible, and
when the sum of the number of full blades and the number of splitter blades is defined as N, an opening angle of the full blade is defined as $\alpha$, and an opening angle of the splitter blade is defined as $\beta$, $\alpha \leq (360°/N)+\beta$.

* * * * *